United States Patent [19]

Brady et al.

[11] 4,111,583

[45] Sep. 5, 1978

[54] ROADWAY JOINT SEAL AND SEALING ASSEMBLY

[75] Inventors: John F. Brady, Wood Dale; Donald J. McDowell, Riverside, both of Ill.

[73] Assignee: Felt Products Mfg. Co., Skokie, Ill.

[21] Appl. No.: 799,594

[22] Filed: May 23, 1977

[51] Int. Cl.[2] ..... E01C 11/04

[52] U.S. Cl. ..... 404/69; 52/396; 14/16.5

[58] Field of Search ..... 404/64, 65, 66, 68, 404/69, 47, 70; 14/16.5; 52/396

[56] References Cited

U.S. PATENT DOCUMENTS

| | | | |
|---|---|---|---|
| 1,706,597 | 3/1929 | Anderson | 404/64 X |
| 2,619,884 | 12/1952 | Jacobson | 404/65 |
| 3,331,294 | 7/1967 | Waller | 404/66 |
| 3,372,521 | 3/1968 | Thom | 404/47 |
| 3,570,378 | 3/1971 | Honegger | 404/69 |
| 3,981,601 | 9/1976 | Arai | 404/68 |

FOREIGN PATENT DOCUMENTS

| | | | |
|---|---|---|---|
| 1,108,751 | 4/1968 | United Kingdom | 404/64 |

*Primary Examiner*—Nile C. Byers

*Attorney, Agent, or Firm*—Dressler, Goldsmith, Clement, Gordon & Shore, Ltd.

[57] ABSTRACT

A sealing system for roadway expansion joint gaps and the like. A continuous seal is provided comprising an elongated central arched segment, a pair of longitudinally extending legs, and a protrusion extending upwardly from each of the legs. The seal embeds at least one fabric reinforcement layer to stiffen, rigidify and strengthen the seal means and the protrusions. The seal is secured to each roadway slab between a horizontal surface and a retainer which defines an elongated recess for sealingly receiving, engaging and compressing a protrusion. A limiter is provided for limiting the compression of the protrusions, and a retainer lip is provided for visually indicating that sealing of a protrusion has been effected.

11 Claims, 8 Drawing Figures

ROADWAY JOINT SEAL AND SEALING ASSEMBLY

This invention relates to improved devices for sealing roadway gaps in the vicinity of the expansion joints for adjacent roadway slabs.

The sealing of roadway gaps is becoming increasingly important and is becoming increasingly required by bridge engineers. Although it has always been important to provide bridge gap spanning devices for purposes of enabling traffic to cross expansion joints, more recently the advantages of overall bridge deck waterproofing and the sealing of gaps against the passage of water and debris has been recognized, especially in those geographic areas in which deicing chemicals and salts are widely used to assist in providing bare pavements during the winter months. The amount of damage which salts and the like have done to bridges and the tremendous maintenance maintenance costs and potential danger to life and property is only now becoming fully apparent.

A wide variety of devices have been developed in the past for improving the sealing of roadway gaps. These range from compression seals disposed in the gaps between slab sections to various kinds of sophisticated and sometimes complex structures which have been suggested for use.

One type of sealing device and system which has met with success is that made in accordance with U.S. Pat. No. 3,713,368 by the assignee of the present application. The integrally molded system of that patent in particular has many advantages.

Another type of system which is currently in vogue is one which provides metal anchorages or profiles for securing a gland or membrane. Typical of systems if this character are those shown in U.S. Pat. Nos. 3,570,378, 3,626,822 and in Swiss Pat. No. 410,034. Typical related devices are waterstops of the type shown in Koester, *Expansion Joints, Transatlantic Arts, Inc.,* 1969, pages 22–39 and 296. These conventional systems and related devices have met with varying degrees of success.

The need remains, however, for improved devices of that type. The devices of the present invention provide improved sealing capability, together with ease of installation, ease of replacement and lesser cost.

In accordance with this invention, an improved sealing system for roadway expansion joint gaps and the like is provided. The sealing system includes a sealing face at each side of a roadway gap and a retainer overlying and secured to each sealing face. A continuous elastomeric seal means extending along the length of the gap is secured at each side of the gap between a sealing face and a retainer.

A continuous seal means comprising an elongated central arched segment, a pair of longitudinally extending legs, one extending from each side of the arched segment, and a protrusion extending upwardly from each of the legs is provided. The seal means embed at least one fabric reinforcement layer which extends from protrusion to stiffen, rigidify and strengthen the seal means and the protrusions. Preferably two reinforcing layers are used and these are disposed on opposite sides of the neutral axis of the arched segment and of the legs.

Each retainer defines an elongated recess for sealingly receiving and engaging a protrusion and further defines a limiter means confronting the sealing face for limiting the compression of said protrusions and a retainer lip for confronting a leg of said seal means for visually indicating that sealing of the protrusion has occurred.

Preferably the depth of the recess is at least fifteen percent less than the height of the protrusion before it is sealingly compressed in the recess and desirably it is at least twenty-five percent less than the height of the protrusion. The width of the recess is advantageously greater than the compressed width of the protrusion. The retainers serve as roadway surfaces and desirably define elongate channels for collecting and channeling debris and for enhancing vehicular traction.

Further objects, features and advantages will become apparent from the following description and drawings of which:

Figure 1:
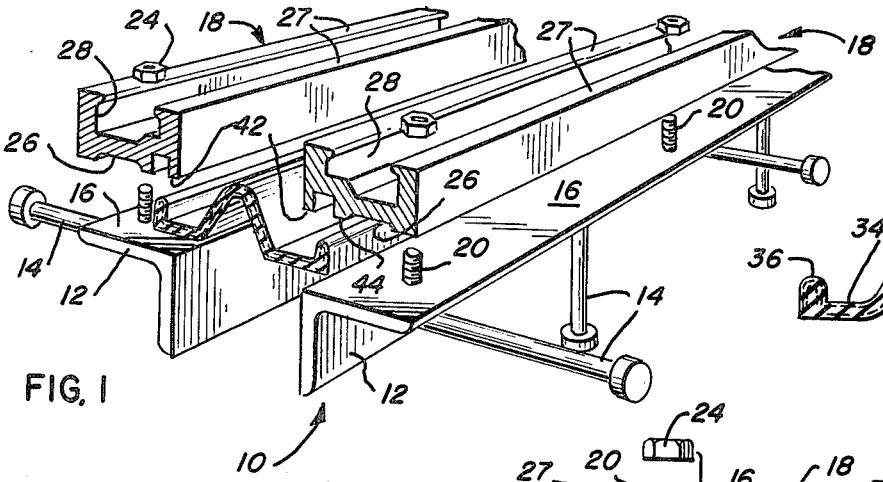
FIG. 1 is an exploded fragmentary perspective view of a sealing system of this invention.
Figure 2:
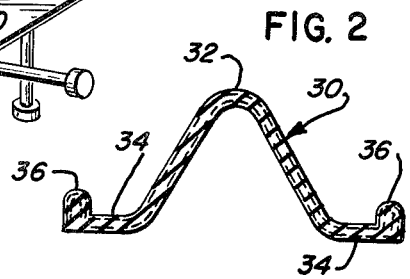
FIG. 2 is an enlarged cross-sectional view of the seal of FIG. 1.
Figure 3:
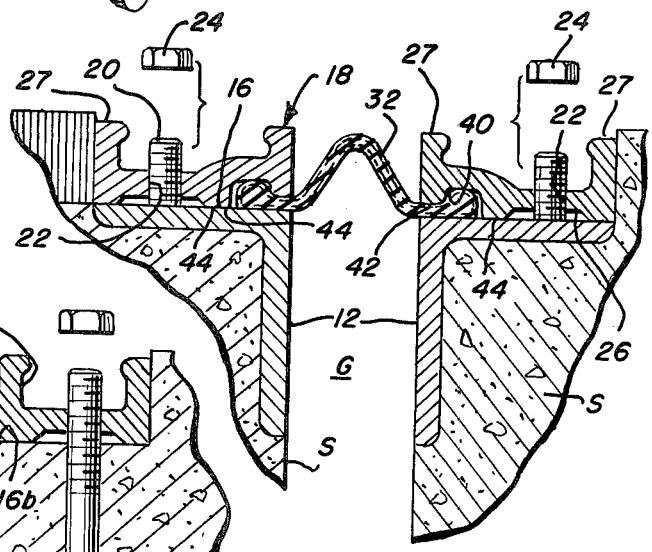
FIG. 3 is a cross-sectional view of the sealing system of FIG. 1.

Referring now to the drawings, and particularly to FIGS. 1 to 3, one embodiment of this invention for sealing a roadway gap G of a deck is seen to incorporate a stud welded anchorage system. To that end, the expansion joint sealing system 10 comprises cast in place shapes such as angles 12 which are provided with suitable stabilizing connectors 14. Connectors 14 are adapted to be embedded in the concrete forming the spaced apart roadway slabs S defining the elongated gap to be sealed, so as to rigidly and accurately locate and position the angles 12. Each angle 12 provides a substantially horizontally disposed portion defining an upper sealing face 16 for a purpose to be described.

Sealing system 10 also incorporates elongate retainers 18 which are preferably made of extruded steel. Elongate retainers 18 are adapted to overlie and to be secured to angles 12 via suitable bolts or studs 20 which may be connected, as by welding, to the angles 12. Aligned stud holes 22 are provided in retainers 18 to receive the studs 22, and nuts 24 are provided to threadedly engage the studs 20 and to hold the retainers in place. Desirably, the lower faces of retainers 18 are formed with longitudinally extending channels 26 to accommodate any additional thickness in the area of the studs resulting from welding.

Each retainer 18 has a pair of elongate upper surfaces 27 that serve as roadway surfaces to accommodate traffic. The elongate upper surfaces 27 are spaced apart from each other is generally parallel relationship to reduce the tendency to skidding which a solid metal surface would produce, i.e., they serve to enhance vehicular traction. A longitudinal channel 28 is defined in the upper face of each retainer 18 between the elongate upper surfaces 27 to serve as a debris and liquid channel which accumulates and carries away debris. The longitudinal channel 28 provides additional recessing for debris and reduces the accumulation of debris in the gap and between the retainers, i.e., the longitudinal channel 28 reduces the amount of debris forced into and onto the seal to be described. This relief of the seal tends to prolong its life. Further, the channels 28 are more easily cleared of debris because they are of steel.

An elongate continuous molded elastomeric seal 30 is secured by retainers 18 to angles 12 to provide a barrier impervious to the passage of water and debris therethrough. Seal 30 preferably comprises an upstanding arched central seal section or segment 32 which in the illustrative embodiment is about one-eighth inch thick. For some ranges of motion of the sealing system 10 the central section 32 of seal 30 may be inverted or downturned and U-shaped.

At its extremities, seal section 32 comprises a pair of outwardly extending legs 34 that have a generally flat or planar bottom surface. Each leg terminates in a bead-like protrusion 36 or foot having a curved upper sealing surface or toe that projects upwardly above other portions of the leg. Protrusions 36 are specially configured to cooperate with angles 12 and retainers 18 to seal the gap G. Most desirably, seal 30 is molded of neoprene rubber.

Figure 2A:
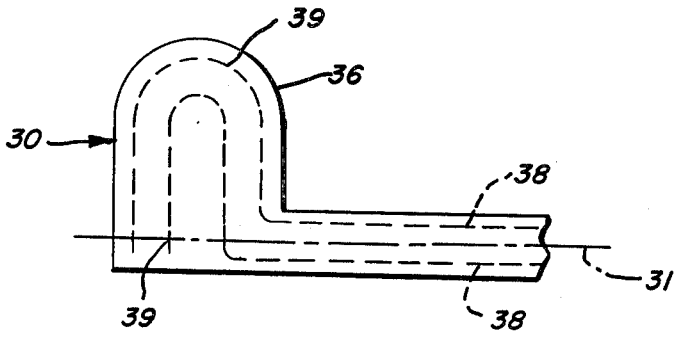
FIG. 2A is an enlarged fragmentary view of FIG. 2.

Seal 30 embeds fabric reinforcement which preferably comprises at least one layer or ply and preferably at least a pair of layers or plies 38 of woven fabric, such as woven polyester. The fabric layers 38 stiffen and stabilize the seal 30, increase its strength, and increase its tear and puncture resistance, all without significantly increasing stress transmission to the anchorages and decks. The multiple fabric layers 38 desirably are spaced on opposite sides of the center of the seal, i.e., on opposite sides of the neutral axis 31 of the seal 30 and as far from the neutral axis 31 as possible both in the central seal section 32 and in the legs 34. In the zone of the protrusion 36, the upper fabric layer is generally looped to follow the contour of the protrusion and the lower fabric layer defines a further reinforcement loop as shown in FIG. 2A. This configuration of the fabric layers and the provision of the loops 39 tends to provide a more rigid and stable protrusion for reasons to be explained. It is also possible to form the protrusion reinforcement with a pair of layers which turn up in the zones of the protrusions and with a pair of separate ply segments which effectively form the downturned loop segements.

When the sealing system is to be installed, the angles 12 and connectors 14 are suitably secured in the roadway. A length of the molded seal 30, preferably the length of the entire gap G to be sealed, is cut. Retainers 18 are loosely secured to the angles 12 along the length of the gap G to be sealed. Retainers 18 need not be as long as the gap G or the seal 30, and they may be installed in segmental or modular lengths. After loosely securing the retainers 18, the protrusions 36 are located in the zone of the longitudinal recesses 40, defined in the lower faces of retainers 18, with inner retainer lips 42, located adjacent the longitudinal recesses 40 on the lower faces of retainers 18 and adjacent gap G, overlying the legs 34 of the seal 30. Thereafter, the nuts 24 are tightened, and the retainers are pulled down into firm sealing engagement with the sealing face 16 of angle 12.

The degree of compression of the protrusions 36 is controlled by lower limiter means or limiter faces 44, located on the lower faces of retainers between the longitudinal channels 26 and recesses 40, respectively. The retainer lips 42 are proportioned relative to the limiter faces so that they confront but do not substantially indent, compress or crush the legs 34. Such an arrangement and construction substantially prevents weakening and tearing of the legs 34 and concentrates the sealing effect in the zone of the protrusion 36 which has been strenthened by the fabric layers 38 to accommodate those effects.

Figure 5:
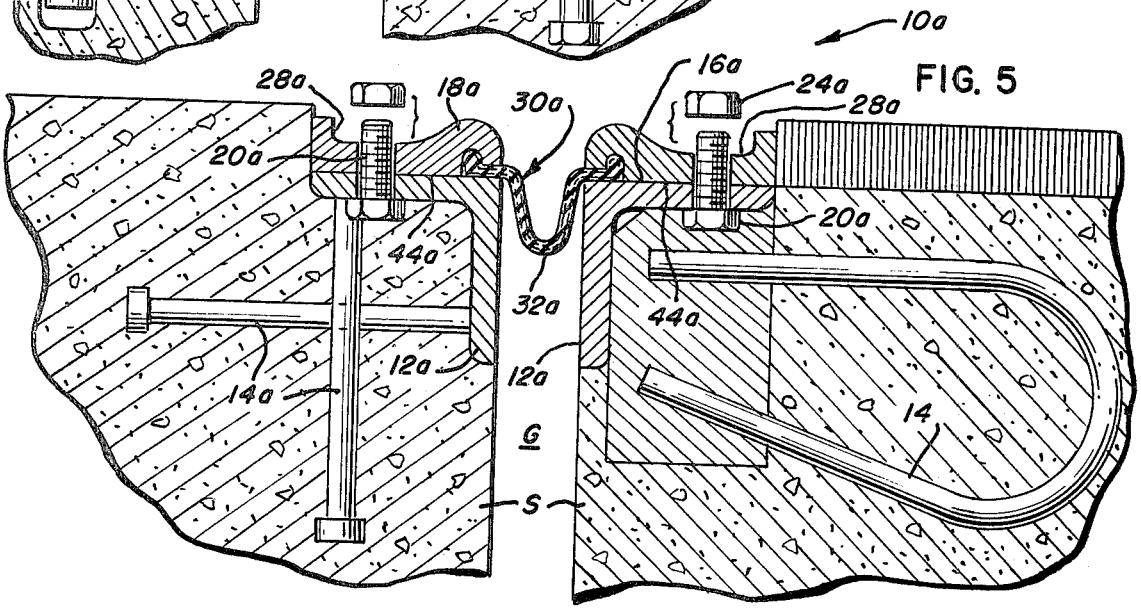
FIG. 5 is a cross-sectional view of another embodiment of this invention.
Figure 6:
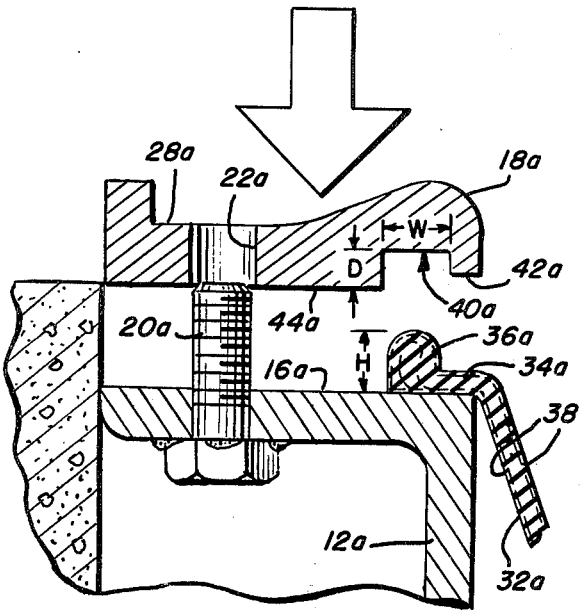
FIG. 6 is an enlarged cross-sectional view of a portion of the sealing system of FIG. 5 with the retainer raised to an upper position prior to installation.
Figure 7:
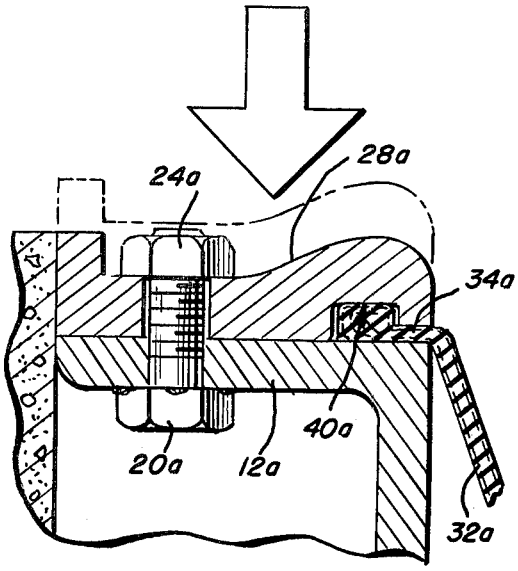
FIG. 7 is a cross-sectional view similar to FIG. 6, but illustrating in solid line the retainer mounted and seated in a lower position after installation and depicting in phantom or dotted-line the retainer in the upper position.

A further embodiment of this invention is illustrated in FIGS. 5–7. This embodiment generally incorporates a low profile, cast in place anchorage system. For ease of comparison, understanding and clarity, the same part numbers as used in connection with the embodiment of FIGS. 1–3 will be used, but with the suffix "*a*."

Sealing system **10*a* comprises angles 12*a* and suitable stabilizing connectors and anchors 14*a* by which angles 12*a* are appropriately cast in place and anchored in slabs S. Each angle 12*a* provides an upper sealing face 16*a*. Upright studs 20*a* are connected, as by welding, to the angles 12*a*. The upper faces of retainers 18*a* define longitudinal channels 28*a* and further define aligned stud holes 22*a* for receiving studs 20*a*. Nuts 24*a* secure retainers 18*a* in sealing engagement against the upper sealing faces 16*a* of the angles 12*a*. The retainers 18*a* resist traffic and snowplow damage and serve to control the impact forces transmitted to the anchorage system. A snowplow guard (not shown) can also be seated on top of the retainers 18*a***.

A seal **30*a* is adapted to be secured by retainers 18*a* to angles 12*a*. Seal 30*a* is similar to seal 30 and is arched in configuration, except that central seal section 32*a*** is downturned or inverted, rather than upstanding.

Seal **30*a* includes a pair of outwardly extending legs 34*a*. Each leg 34*a* terminates in a bead-like protrusion 36*a* which is adapted and configured to cooperate with angles 12*a* and retainers 18*a* to seal the gap G. Fabric layers 38*a*, which can be the same as, and located the same as layers 38, are provided in the seal 30*a***.

When the seal **30*a* is to be secured in place, it is positioned with the protrusions 36*a* to underlie recesses 40*a* in retainers 18*a*. Each retainer 18*a* is gradually moved from the position of FIG. 6 to that of FIG. 7 and secured by nuts 24*a*. Limiter faces 44*a* limit compression of the protrusions 36*a* and retainer lips 42*a* overlie and protect legs 34*a*. Retainer lips 42*a* also serve as a restrictor helping to prevent pullout of the protrusions 36*a***.

As best seen in FIGS. 6 and 7, the depth of longitudinal recess **40*a* is proportioned relative to the height of the protrusions 36*a* to provide surfaces for compressing and clamping the protrusions 36*a*. The width of each protrusion 36*a* is also proportioned so that the volume of each recess 40*a* will permit the protrusions 36*a*, when compressed, to flow sufficiently laterally so that the limiter faces 44*a* contact the sealing face 16*a*. The protrusions 36*a* are further of a size, shape and proportion to control the degree of compression, and to provide a visual indication, via the touching of the lips 42*a* to the legs 34*a*, that the seal 30*a*** has been properly seated and secured in place.

It has been determined that the depth D of the recesses **40*a*, when the retainer is fully seated, as is illustrated in FIGS. 6 and 7 should be at least 15% less, and preferably at least 25% less than the height H of the uncompressed protrusion 36*a*. The width W of each recess 40*a* should be sufficiently wide in relation to the depth of the recess 40*a* and the volume of the protrusion 36*a* so that as the protrusion 36*a*** is distorted and flows, the recess 40*a* will accommodate the displaced protrusion material without creating a hydraulic lock. Preferably, the width W of each recess 40*a* should be slightly greater than the compressed protrusion 36*a* so as to provide sufficient clearance and tolerance for minor misalignments of laterally adjacent retainer sections (which may be about 10 feet long). The width W of each recess 40*a* should be great enough to permit the protrusion 36*a* to be received in the adjacent recesses during these minor misalignments. If the recesses 40*a* are not wide enough, the protrusion may tend to underlie either a lip 42*a* or a limiter face 44*a* at the intersection of a pair of laterally adjacent retainers 18*a* and may make assembly difficult or cumbersome.

It is also important that the degree of compression, i.e., the difference between height H of the protrusion and depth D of the recess, take into consideration the spacing and formation of the fabric reinforcement in the protrusion. When configured, such as illustrated in FIG. 2A, and in the other drawings, the reinforcement is such that it restrains pullout and limits extrusion of the protrusion through the gap between the lip and the confronting sealing face. These advantages are similarly present in seals 30 and 30*b*.

Figure 4:
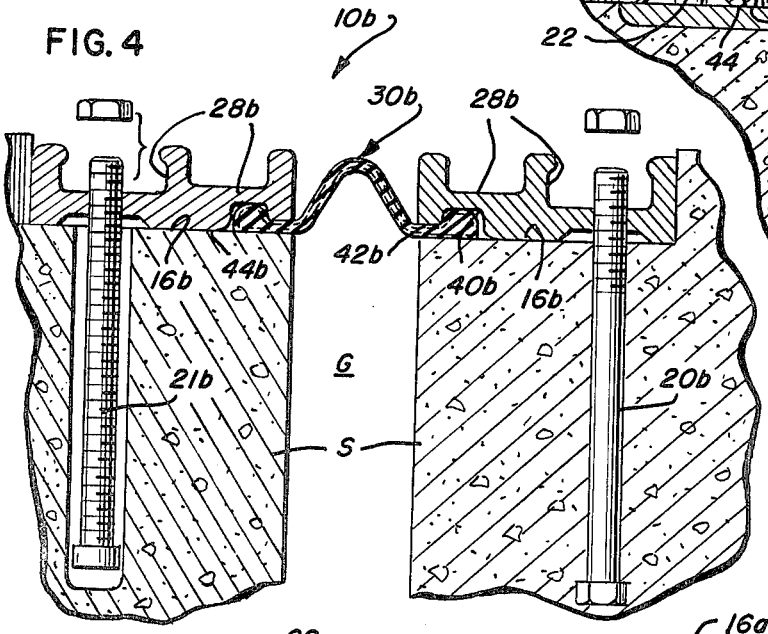
FIG. 4 is a cross-sectional view of a further embodiment of this invention.

FIG. 4 illustrates a further embodiment of this invention which generally incorporates a concrete anchorage system. For ease of understanding, clarify and comparison, the parts and structural elements of the embodiment of FIG. 4, which are similar to the parts and structural elements of FIGS. 1–3, have been given similar part numbers, but with the suffix "*b*."

In the embodiment of FIG. 4, the slabs S are proportioned to provide an upper sealing face 16*b*. The slabs are provided, selectively, either with cast in place anchorage bolts 20*b* or epoxy grouted anchorage bolts 21*b*. Retainers 18*b* define longitudinally aligned bolt holes 22*b* and provide longitudinal recesses 40*b*, retainer lips 42*b* and limiter faces 44*b* which cooperate with seal 30*b* and sealing face 16*b* in a manner substantially as described with respect to the embodiments of FIGS. 1–3 and 5–7. The seal 30*b* is similar to seal 30 and 30*a* and has an upstanding arched central section 32*b*. For some ranges of motion of the sealing system 10*b*, the central section 32*b* of seal 30 may desirably be inverted or downturned.

To enhance the sealing capacity of the systems 10, 10*a* and 10*b*, in situations where it is not practicable to cast the roadway surface against the retainers 18 and/or where it would be advantageous to seat the retainers 18 in a formed out notch, it may be desirable to use supplemental sealants and adhesives against the roadway surfaces where the outer edges of the retainers 18 bear against roadway material. Additional sealants can also be used elsewhere in the system, where desired, although they should not be necessary if proper construction and assembly techniques are used.

The sealing systems of this invention are generally easily installed and readily replaceable and provide an effective water-tight seal for a roadway gap. The fabric reinforced seals resist tearing, puncturing and damaging distortion. The sealing systems may be used in longitudinal, transverse and skewed joints and are so constructed and arranged to accommodate vertical, horizontal and skewed movements, without transmitting significant deleterious forces to the anchor bolts, piers, abutments or the deck. Because the seal is molded, its dimensions may be held to close tolerances, maximizing its effectiveness in use. And, when the seal is upstanding, it will tend to eject debris and will tend to selfclean. Whether the seal is upstanding or downturned, the seal will maintain its shape throughout the motion cycle of the system.

Furthermore, the retainers of the present invention may be welded in sections at curbs and gutters to provide for a continuous seal across a deck and up the adjacent curbs.

Although only several embodiments of the present invention have been illustrated and described in detail, it will be apparent to those skilled in the art that modifications and additional usages may be made without departing from the spirit and scope of the invention. Accordingly, the invention is intended to be limited only in accordance with the appended claims.

We claim:

1. A sealing system for roadway expansion joint gaps and the like comprising: roadway slabs defining an elongated gap, a first sealing face at each side of said gap, a retainer overlying each said sealing face, continuous elastomeric seal means extending along the length of the gap and secured at each side of the gap between a said sealing face and a said retainer and means for securing said retainer to said first sealing face said continuous seal means comprising an elongated central arched segment, a pair of longitudinally extending legs, one extending from each side of said arched segment, and a protrusion extending upwardly from each of said legs, said seal means embedding at least one fabric reinforcement layer, said fabric layer generally extending from protrusion to protrusion to stiffen, rigidify, and strengthen said seal means and said protrusions, each said retainer defining an elongated recess sealingly receiving, engaging and compressing a said protrusion, defining limiter means for confronting said sealing face for limiting the compression of said protrusions, and defining a retainer lip confronting a leg of said seal means for visually indicating that sealing of said protrusion has been effected, said recess having a depth less than the uncompressed height of said protrusion.

2. A sealing system for roadway expansion joint gaps and the like in accordance with claim 1 wherein the depth of said recess is at least 15% less than the height of said protrusion before it is sealingly compressed in said recess.

3. A sealing system for roadway expansion joint gaps and the like in accordance with claim 2 wherein the depth of said recess is at least 25% less than the said height of said protrusion.

4. A sealing system for roadway expansion joint gaps and the like in accordance with claim 2 wherein the width of the recess is greater than the compressed width of said protrusion.

5. A sealing system for roadway expansion joint gaps and the like in accordance with claim 1 wherein said retainers provide roadway surfaces, and said roadway surfaces define elongate channels for collecting and channeling debris and for enhancing vehicular traction.

6. A sealing system for roadway expansion joint gaps and the like in accordance with claim 1 wherein said fabric reinforcement comprises at least two layers which are spaced apart and which are on opposite sides of the neutral axis of said arched segment and said legs.

7. A sealing system for roadway expansion joint gaps and the like in accordance with claim 6 wherein at least one of said layers defines a reinforcement loop in each of said protrusions.

8. A sealing system for roadway expansion joint gaps and the like in accordance with claim 1 and wherein said first sealing face comprises a metallic shape secured to each slab adjacent said gap, and said shape is substantially horizontally disposed.

9. A sealing system for roadway expansion joint gaps and the like comprising: roadway slabs defining an elongated gap, a first sealing face at each side of said gap, a retainer overlying each said sealing face and defining a roadway surface, said roadway surface defining at least one elongated channel for collecting debris and for enhancing vehicular traction, continuous elastomeric seal means extending along the length of the gap and secured at each side of the gap between a said sealing face and a said retainer, and means for securing said retainer to said first sealing face, said continuous seal means comprising an elongated central arched segment, a pair of longitudinally extending legs, one extending from each side of said arched segment, and a protrusion extending upwardly from each of said legs, said seal means embedding at least one fabric reinforcement layer, said fabric layer generally extending from protrusion to stiffen, rigidify and strengthen said seal means and said protrusions, each said retainer defining an elongated recess sealingly receiving, engaging and compressing a said protrusion, defining limiter means for confronting said sealing face for limiting the compression of said protrusions, and defining a retainer lip confronting a leg of said seal means for visually indicating that sealing of said protrusion has been effected, and wherein the depth of the recess is at least 15 percent less than the uncompressed height of said protrusion and the width of the recess is greater than the compressed width of said protrusion.

10. A sealing system for roadway expansion joint gaps and the like in accordance with claim 9 wherein said fabric reinforcement comprises at least two layers which are spaced apart and which are on opposite sides of the neutral axis of said arched segment and said legs.

11. An elongated continuous molded elastomeric seal means adapted for use in a sealing system for roadway expansion joint gaps and the like, and adapted to extend along the length of a gap and to be secured at each side of a gap between a sealing face and a retainer defining a recess for clampingly engaging a seal means protrusion, said continuous seal means being thin and flexible and comprising an elongated central arched segment, a pair of elongated legs, one extending from each side of said arched segment, and a thickened portion comprising a protrusion extending upwardly from each of said legs, and at least two fabric reinforcement layers which are spaced apart and which are on opposite sides of the neutral axis of said arched segment and of said legs embedded in said seal means and extending from protrusion to protrusion, and a fabric reinforcement loop in each said protrusion whereby said fabric reinforcement stiffens, rigidifies and strengthens said seal means and said protrusions.

* * * * *

UNITED STATES PATENT AND TRADEMARK OFFICE

CERTIFICATE OF CORRECTION

PATENT NO. : 4,111,583

DATED : September 5, 1978

INVENTOR(S) : John F. Brady and Donald J. McDowell

It is certified that error appears in the above-identified patent and that said Letters Patent are hereby corrected as shown below:

Column 1, line 20, delete "maintenance" (second occurrence);

Column 1, line 39, before "Koester" insert -- U.S. Pat. 2,246,903 and devices of the types shown in --;

Column 1, line 61, after "protrusion" insert -- to protrusion --;

Column 2, line 63, "is" should be -- in --;

Claim 1, Column 6, line 24, before "said" (third occurrence) insert a comma -- , --;

Claim 9, line 23, before "stiffen" insert -- protrusion to --

Signed and Sealed this

*Fifth* Day of *June 1979*

[SEAL]

*Attest:*

RUTH C. MASON
*Attesting Officer*

DONALD W. BANNER
*Commissioner of Patents and Trademarks*